US012601157B2

(12) United States Patent
Zhang et al.

(10) Patent No.: US 12,601,157 B2
(45) Date of Patent: Apr. 14, 2026

(54) METHOD FOR ESTABLISHING ELECTRONIC FENCE FOR EXCAVATOR

(71) Applicant: XUZHOU XCMG EXCAVATOR MACHINERY CO., LTD, Xuzhou (CN)

(72) Inventors: Bin Zhang, Xuzhou (CN); Zhike Song, Xuzhou (CN); Jiawen Geng, Xuzhou (CN); Dongdong Niu, Xuzhou (CN); Xiangwei Lin, Xuzhou (CN); Dunkun Wang, Xuzhou (CN); Zecheng Xing, Xuzhou (CN); Hongmin Wei, Xuzhou (CN); Xuefeng Yin, Xuzhou (CN)

(73) Assignee: XUZHOU XCMG EXCAVATOR MACHINERY CO., LTD, Xuzhou (CN)

( * ) Notice: Subject to any disclaimer, the term of this patent is extended or adjusted under 35 U.S.C. 154(b) by 124 days.

(21) Appl. No.: 18/694,017

(22) PCT Filed: Feb. 21, 2022

(86) PCT No.: PCT/CN2022/077062
§ 371 (c)(1),
(2) Date: Mar. 21, 2024

(87) PCT Pub. No.: WO2023/045234
PCT Pub. Date: Mar. 30, 2023

(65) Prior Publication Data

US 2024/0384509 A1 Nov. 21, 2024

(30) Foreign Application Priority Data

Sep. 27, 2021 (CN) ..... 202111134390.8

(51) Int. Cl.
*E02F 9/26* (2006.01)

(52) U.S. Cl.
CPC ..... *E02F 9/265* (2013.01); *E02F 9/262* (2013.01)

(58) Field of Classification Search
CPC . E02F 9/265; E02F 9/262; E02F 9/264; E02F 9/2033; E02F 9/2045; E02F 3/435
See application file for complete search history.

(56) References Cited

U.S. PATENT DOCUMENTS

2022/0170242 A1* 6/2022 Maley ..... G06T 7/70

FOREIGN PATENT DOCUMENTS

CN 108549771 A 9/2018
CN 109440852 A 3/2019
(Continued)

OTHER PUBLICATIONS

English Translation of CN111877444 cited on IDS (Year: 2020).*
(Continued)

*Primary Examiner* — Russell Frejd
(74) *Attorney, Agent, or Firm* — Calfee, Halter & Griswold LLP

(57) ABSTRACT

The present disclosure relates to a method for establishing an electronic fence for an excavator, wherein the excavator includes a frame, a slewing platform rotatably mounted on the frame, a working arm mounted on the slewing platform in a pitching swinging manner, and a bucket rotatably mounted on the working arm. The working arm includes a first working arm hinged to the slewing platform and a second working arm hinged to the first working arm. An end, away from the first working arm, of the second working arm is hinged to the bucket. The method includes: establishing a three-dimensional coordinate system including an X-axis, a Y-axis, a Z-axis, and an origin O; and obtaining boundary lines of working areas of the working arm and the bucket of the excavator in a same height plane in the three-dimen-
(Continued)

sional coordinate system, including: obtaining coordinates, in the three-dimensional coordinate system, of multiple boundary points of the working areas at the same along a circumferential direction of the excavator; and connecting two adjacent boundary points to form multiple straight lines connected in sequence, and taking the boundary lines formed by the multiple straight lines as the electronic fence.

10 Claims, 2 Drawing Sheets

(56) References Cited

FOREIGN PATENT DOCUMENTS

| | | | |
|---|---|---|---|
| CN | 111877444 | A | 11/2020 |
| CN | 112837482 | A | 5/2021 |
| CN | 113047367 | A | 6/2021 |
| CN | 113047368 | A | 6/2021 |
| CN | 113565165 | A | 10/2021 |
| EP | 3868963 | A1 | 8/2021 |
| KR | 1020020085663 | A | 11/2002 |
| WO | 2006106685 | A1 | 10/2006 |
| WO | 2018164079 | A1 | 9/2018 |

OTHER PUBLICATIONS

Office Action from Chinese Application No. 202111134390.8 dated Nov. 4, 2021.
Office Action from Chinese Application No. 202111134390.8 dated Nov. 26, 2021.
Notice of Allowance from Chinese Application No. 202111134390.8 dated Jan. 12, 2022.
International Search Report & Written Opinion from PCT/CN2022/077062 dated May 26, 2022.
Extended European Search Report from EP Application No. 22871300.4 dated Jul. 22, 2025.

* cited by examiner

METHOD FOR ESTABLISHING ELECTRONIC FENCE FOR EXCAVATOR

CROSS-REFERENCE TO RELATED APPLICATIONS

This application is a U.S. National Stage Application under 35 U.S.C. § 371 of International Patent Application No. PCT/CN2022/077062, filed on Feb. 21, 2022, which is based on and claims priority to Chinese Patent Application No. CN 202111134390.8, filed on Sep. 27, 2021, the entire contents of which are incorporated herein by reference.

FIELD OF THE DISCLOSURE

The present disclosure relates to the field of automatic control technology in engineering machinery, and more particularly, to a method for establishing an electronic fence for an excavator.

BACKGROUND OF THE DISCLOSURE

An excavator includes a frame, a slewing platform mounted on the frame, a first arm mounted on the slewing platform in a pitching swinging manner, a second arm hinged to the first arm, and a bucket hinged to the second arm. The slewing platform is configured to rotate in a horizontal plane with respect to the frame, one end of the second arm is hinged to the first arm, and other end is hinged to the bucket. The second arm is configured to swing in a vertical plane with respect to the first arm, and the bucket is configured to pitch and swing in the vertical plane with respect to the second arm.

A hydraulic system of the excavator includes a driving component for driving rotation of the slewing platform, where the driving component includes one of a hydraulic cylinder and a hydraulic motor. The hydraulic system also includes a first hydraulic cylinder for driving the first arm to pitch and swing with respect to the slewing platform, a second hydraulic cylinder for driving the second arm to swing with respect to the first arm, and a third hydraulic cylinder for driving the bucket to swing with respect to the second arm.

The excavator also includes a first angle sensor for detecting a slewing angle of the slewing platform with respect to the frame, a second angle sensor for detecting an angle of the first arm with respect to the slewing platform, a third angle sensor for detecting an angle of the second arm with respect to the first arm, and a fourth angle sensor for detecting an angle of the bucket with respect to the second arm.

A controller of the excavator is in signal connection to the first to fourth angle sensors and the hydraulic system to limit an operating range of the bucket of the excavator, thereby forming an electronic fence.

With the advancement of technologies, intelligent development of the excavator has also entered an acceleration period. In some special operations such as emergency rescue, slope repair, and leveling, the excavator is more or less used for unmanned construction. However, in some special occasions, especially some occasions where activity space is smaller and changes with height, such as mine excavation, irregular deep pit cleaning operations, etc., it is required to limit the operating range of the excavator, to avoid causing a car accident or misdigging.

In related technologies, for the electronic fence, it is only considered a horizontal distance between the bucket and an obstacle to limit an operating radius of the bucket, but complex specific operating scenarios are not taken into account, which results in a consequence that a movement area of the bucket is improperly restricted.

SUMMARY OF THE DISCLOSURE

A main objective of the present disclosure is to provide a method for establishing an electronic fence for an excavator, to improve a problem of inconsistency between the electronic fence of the excavator and actual operating scenarios in related technologies.

According to one aspect of an embodiment of the present disclosure, there is provided a method for establishing an electronic fence for an excavator, where the excavator includes a frame, a slewing platform rotatably mounted on the frame, a working arm mounted on the slewing platform in a pitching swinging manner, and a bucket rotatably mounted on the working arm. The working arm includes a first working arm hinged to the slewing platform and a second working arm hinged to the first working arm. An end, away from the first working arm, of the second working arm is hinged to the bucket. The method includes: establishing a three-dimensional coordinate system, which includes an X-axis, a Y-axis, a Z-axis, and an origin O; and obtaining boundary lines of working areas of the working arm and the bucket of the excavator in a same height plane in the three-dimensional coordinate system, including: obtaining coordinates, in the three-dimensional coordinate system, of multiple boundary points of the working areas at the same height along a circumferential direction of the excavator; and connecting two adjacent boundary points to form multiple straight lines connected in sequence, and taking the boundary lines formed by the multiple straight lines as the electronic fence.

In some embodiments, the X-axis and the Y-axis of the three-dimensional coordinate system are positioned in a same horizontal plane, and the Z-axis of the three-dimensional coordinate system extends along a vertical direction.

In some embodiments, the origin O of the three-dimensional coordinate system is a hinge point between the working arm and the slewing platform.

In some embodiments, either one of the X-axis and the Y-axis extends along a width direction of the excavator, and other one extends along a length direction of the excavator.

In some embodiments, the method also includes: calculating a function equation $y=fn(x)$ of a straight line connecting two adjacent boundary points based on coordinates of the two adjacent boundary points, where n is a natural number and represents number of the straight line; and monitoring coordinates of a monitoring point on the working arm and/or bucket, and determining whether the coordinates of the monitoring point are within the boundary lines.

In some embodiments, the determining whether the coordinates of the monitoring point are within the boundary lines includes: substituting the coordinate values x and y of the coordinates of the monitoring point into a function equation $y-fn(x)$ to determine whether a calculation result is positive or negative. It is determined that the monitoring point is within the boundary lines when the calculation result is a predetermined result.

In some embodiments, the method also includes setting the predetermined result. The setting the predetermined result includes: placing the monitoring point at a test point within the boundary lines, and substituting the coordinate values x and y of the test point into the function equation $y-fn(x)$ to determine whether the calculation result is positive or negative. The predetermined result is negative when the calculation result is a negative number, and the predetermined result is positive when the calculation result is a positive number.

In some embodiments, obtaining the coordinates of the boundary point in the three-dimensional coordinate system includes: measuring or calculating a distance between the boundary point and the excavator and an azimuth angle relative to the excavator; and calculating the coordinates of the boundary point in the three-dimensional coordinate system based on the distance and the azimuth angle.

In some embodiments, obtaining the coordinates of the boundary point in the three-dimensional coordinate system includes:

moving the monitoring point on the working arm and/or bucket to one boundary point of the working area, reading coordinates of the monitoring point, and taking the coordinates as the coordinates of the boundary point.

In some embodiments, the monitoring point limited within the boundary lines on the working arm and/or bucket includes: a first monitoring point positioned at a tip of the bucket at an end away from the second working arm; and/or a second monitoring point positioned at an end on a bottom of the bucket away from the second working arm; and/or a third monitoring point positioned at an end on the bottom of the bucket close to the second working arm; and/or a fourth monitoring point positioned at an end on a top of the bucket close to the second working arm; and/or a fifth monitoring point positioned at an end of the first working arm close to the second working arm.

In some embodiments, multiple boundary lines of the working area of the working arm and the bucket of the excavator are obtained at a height in the three-dimensional coordinate system, and the multiple boundary lines are taken as the electrical fence.

By applying the technical solutions of the present disclosure, multiple boundary points are fitted to obtain the boundary lines serving as the electronic fence, which improves the problem of inconsistency between the electronic fence of the excavator and actual operating scenarios in the related technologies.

Other features and advantages of the present disclosure will become clear through the detailed description of the exemplary embodiments of the present disclosure with reference to the accompanying drawings.

BRIEF DESCRIPTION OF THE ACCOMPANYING DRAWINGS

The drawings as a part of the present disclosure are used to provide further understanding of the present disclosure. Illustrative embodiments of the present disclosure and description thereof are used for explaining the present disclosure but do not improperly limit the present disclosure. In the drawings.

DETAILED DESCRIPTION OF THE PREFERRED EMBODIMENTS

It should also be noted that the embodiments in the present disclosure and the features in the embodiments may be combined with each other on a non-conflict basis. The present disclosure will be described below in detail with reference to the accompanying drawings and in combination with the embodiments.

Figure 1:
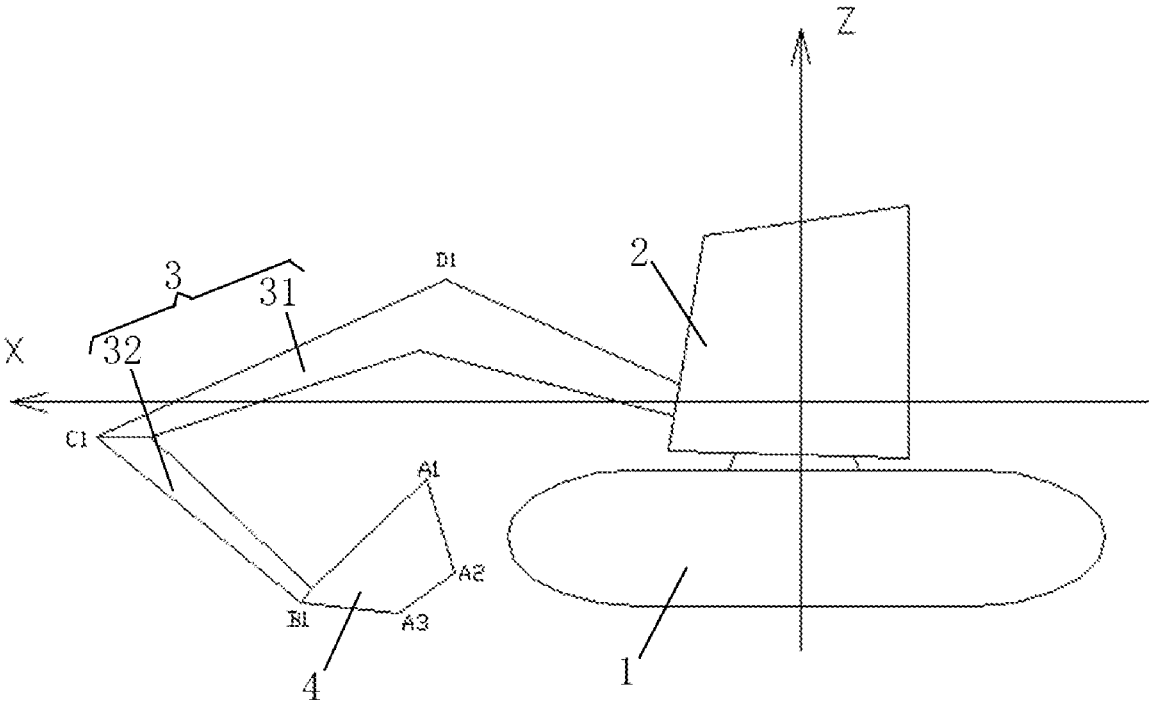
FIG. 1 shows a schematic structural diagram of an excavator according to an embodiment of the present disclosure.
Figure 2:
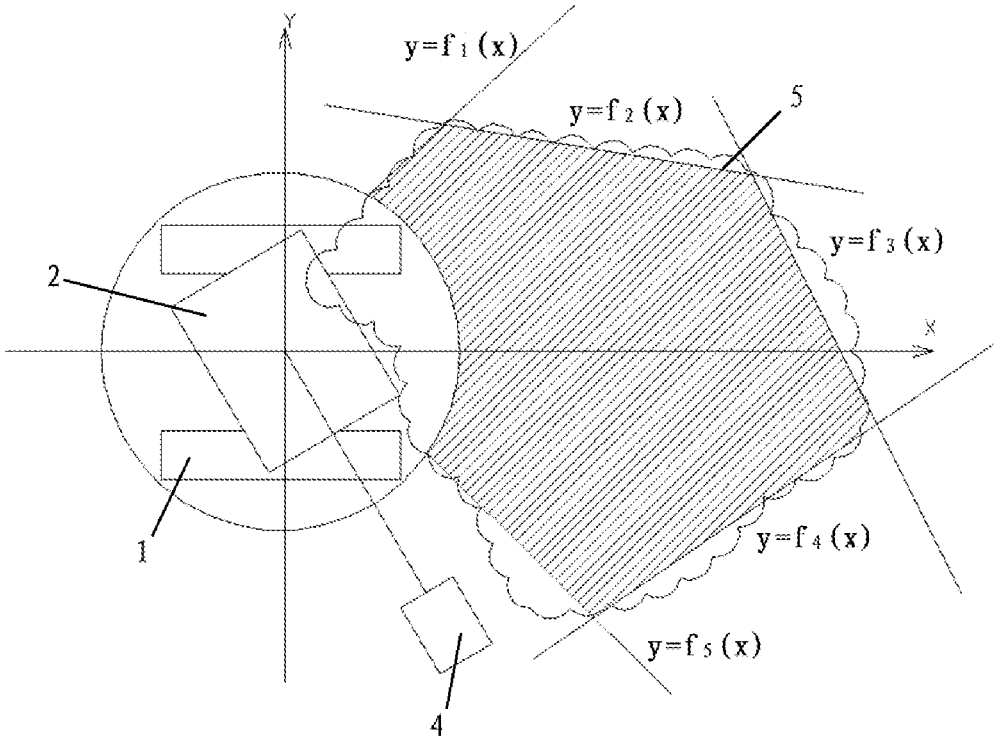
FIG. 2 shows a schematic diagram of an electronic fence of the excavator according to an embodiment of the present disclosure.

With reference to FIGS. 1 and 2, a method for establishing an electronic fence for an excavator is shown. The excavator includes a frame 1, a slewing platform 2 rotatably mounted on the frame 1, a working arm 3 mounted on the slewing platform 2 in a pitching swinging manner, and a bucket 4 rotatably mounted on the working arm 3. The working arm 3 includes a first working arm 31 hinged to the slewing platform 2 and a second working arm 32 hinged to the first working arm 31. An end, away from the first working arm 31, of the second working arm 32 is hinged to the bucket 4.

The method includes: establishing a three-dimensional coordinate system, which includes an X-axis, a Y-axis, a Z-axis, and an origin O; and obtaining boundary lines 5 of working areas of the working arm 3 and the bucket 4 of the excavator in a same height plane in the three-dimensional coordinate system, including: obtaining coordinates, in the three-dimensional coordinate system, of multiple boundary points of the working areas at the same height along a circumferential direction of the excavator; and connecting two adjacent boundary points to form multiple straight lines connected in sequence, and taking the boundary lines 5 formed by the multiple straight lines as the electronic fence.

In this embodiment, the boundary lines 5 serving the electronic fence are fitted through the multiple boundary points, which improves the problem of inconsistency between the electronic fence of the excavator and the actual operating scenarios in the related technologies.

The method also includes: calculating a function equation $y=fn(x)$ of a straight line connecting two adjacent boundary points based on coordinates of the two adjacent boundary points, where n is a natural number and represents number of the straight line; and monitoring coordinates (x, y) of a monitoring point on the working arm 3 and/or bucket 4, and determining whether the coordinates (x, y) of the monitoring point are within the boundary lines 5.

The determining whether the coordinates values x and y of the monitoring point are within the boundary lines 5 includes: substituting the coordinate values x and y of the coordinates (x, y) of the monitoring point into a function equation $y-fn(x)$ to determine whether a calculation result is positive or negative. It is determined that the monitoring point is within the boundary lines 5 when the calculation result is a predetermined result.

The method also includes setting the predetermined result. The setting the predetermined result includes: placing the monitoring point at a test point (x, y) within the boundary lines 5, and substituting the coordinate values x and y of the test point into the function equation $y-fn(x)$ to determine whether the calculation result is positive or negative. The predetermined result is negative when the calculation result is a negative number, and the predetermined result is positive when the calculation result is a positive number.

As shown in FIG. 2, the boundary lines 5 of this embodiment include 5 straight lines, whose function equations are $y=f1(x)$, $y=f2(x)$, $y=f3(x)$, $y=f4(x)$, and $y=f5(x)$, respectively. A controller monitors the coordinates of the monitoring point on the working arm 3 and/or bucket 4 in real time, and substitutes the coordinate values x and y of the coordinates into the function equation $y-fn(x)$ to determine whether the calculation result is positive or negative. When the calculation result is the predetermined result, it is determined that the monitoring point is positioned within the boundary lines 5, where n is 1 to 5. That is, the coordinate values x and y are substituted into the function equations y−f1(x), y−f2(x), y−f3(x), y−f4(x) and y−f5(x) to determine the results.

In some embodiments, obtaining the coordinates of the boundary point in the three-dimensional coordinate system includes: measuring or calculating a distance between the boundary point and the excavator and an azimuth angle relative to the excavator; and calculating the coordinates of the boundary point in the three-dimensional coordinate system based on the distance and the azimuth angle.

In some other embodiments, obtaining the coordinates of the boundary point in the three-dimensional coordinate system includes: moving the monitoring point on the working arm 3 and/or bucket 4 to one boundary point of the working area, reading coordinates of the monitoring point, and taking the coordinates as the coordinates of the boundary point.

The monitoring points limited within the boundary lines 5 on the working arm 3 and/or bucket 4 include a first monitoring point A1, a second monitoring point A2, a third monitoring point A3, a fourth monitoring point B2, and a fifth monitoring point C1.

The first monitoring point A1 is positioned at a tip of the bucket 4 at an end away from the second working arm 32. The second monitoring point A2 is positioned at an end on a bottom of the bucket 4 away from the second working arm 32. The third monitoring point A3 is positioned at an end on the bottom of the bucket 4 close to the second working arm 32. The fourth monitoring point B2 is positioned at an end on a top of the bucket 4 close to the second working arm 32. The fifth monitoring point C1 is positioned at an end of the first working arm 31 close to the second working arm 32.

The X-axis and the Y-axis of the three-dimensional coordinate system are positioned in a same horizontal plane, and the Z-axis of the three-dimensional coordinate system extends along a vertical direction.

In some embodiments, the origin O of the three-dimensional coordinate system is a hinge point between the working arm 3 and the slewing platform 2.

In some embodiments, either one of the X-axis and the Y-axis extends along a width direction of the excavator, and other one extends along a length direction of the excavator. In this embodiment, the X-axis extends along the length direction of the excavator, that is, a direction of travel of the excavator. Either one of the X-axis and the Y-axis extends along the width direction of the excavator.

Figure 3:
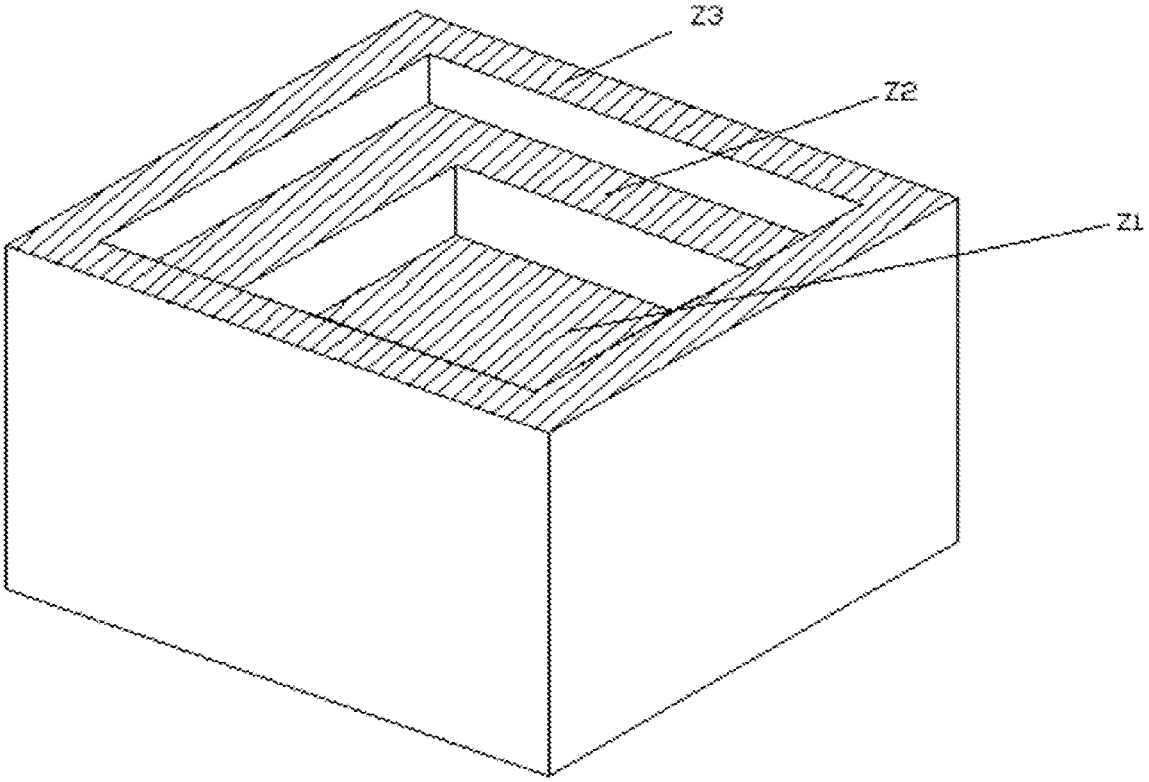
FIG. 3 shows a schematic diagram of operating principles of the excavator according to an embodiment of the present disclosure.

In some embodiments, multiple boundary lines 5 of the working area of the working arm 3 and the bucket 4 of the excavator are obtained at a height in the three-dimensional coordinate system, and the multiple boundary lines 5 are taken as the electrical fence. As shown in FIG. 3, by taking excavating a pond with stairs as an example, it is described how to divide different movement areas based on different heights. When a Z-axis value is between Z1 and Z2, the movement area is a cylindrical area with a plane indicated by Z1 as a bottom and with a height of Z2 minus Z1. When the Z-axis value is between Z2 and Z3, the movement area is a cylindrical area with the plane indicated by Z1 plus a plane indicated by Z2 as a bottom and with a height of Z3 minus Z2. When the Z-axis value is greater than Z3, the movement area is a cylindrical area with the plane indicated by Z1 plus the plane indicated by Z2 plus a plane indicated by Z3 as a bottom. In this case, boundaries of the pond may be obtained based on its predetermined size, thereby calculating a distance and an azimuth angle between a boundary point of the pond and the excavator, and then obtaining the boundary lines 5.

The above are merely preferred embodiments of the present disclosure and are not intended to limit the present disclosure. To those skilled in the art, the present disclosure may have various modifications and changes. All modifications, equivalent substitutions and improvements made within the spirit and principle of the present disclosure shall fall within the protection scope of the present disclosure.

The invention claimed is:

1. A method for establishing an electronic fence for an excavator, wherein the excavator comprises a frame, a slewing platform rotatably mounted on the frame, a working arm mounted on the slewing platform in a pitching swinging manner, and a bucket rotatably mounted on the working arm, the working arm comprising a first working arm hinged to the slewing platform-and a second working arm hinged to the first working arm, an end, away from the first working arm, of the second working arm is hinged to the bucket, and the method comprising:

establishing a three-dimensional coordinate system comprising an X-axis, a Y-axis, a Z-axis, and an origin O;

obtaining boundary lines of working areas of the working arm and the bucket of the excavator in a same height plane in the three-dimensional coordinate system, comprising: obtaining coordinates, in the three-dimensional coordinate system, of multiple boundary points of the working areas at the same height along a circumferential direction of the excavator; and connecting two adjacent boundary points to form multiple straight lines connected in sequence, and taking the boundary lines formed by the multiple straight lines as the electronic fence;

calculating a function equation y=fn(x) of a straight line connecting two adjacent boundary points based on coordinates of the two adjacent boundary points, wherein n is a natural number and represents a number of the straight line; and monitoring coordinates (x, y) of a monitoring point on the working arm and/or bucket, and determining whether the coordinates (x, y) of the monitoring point are within the boundary lines, wherein a hydraulic system of the excavator comprises a driving component for driving rotation of the slewing platform, a first hydraulic cylinder for driving the first working arm to pitch and swing with respect to the slewing platform, a second hydraulic cylinder for driving the second working arm to swing with respect to the first working arm, and a third hydraulic cylinder for driving the bucket to swing with respect to the working second arm, wherein the excavator also comprises a first angle sensor for detecting a slewing angle of the slewing platform with respect to the frame, a second angle sensor for detecting an angle of the first working arm with respect to the slewing platform, a third angle sensor for detecting an angle of the second working arm with respect to the first working arm, and a fourth angle sensor for detecting an angle of the bucket with respect to the second arm, and wherein a controller of the excavator is in signal connection to the first to fourth angle sensors and the hydraulic system to limit an operating range of the bucket of the excavator.

2. The method according to claim 1, wherein the X-axis and the Y-axis of the three-dimensional coordinate system are positioned in a same horizontal plane, and the Z-axis of the three-dimensional coordinate system extends along a vertical direction.

3. The method according to claim 2, wherein the origin O of the three-dimensional coordinate system is a hinge point between the working arm and the slewing platform.

4. The method according to claim 2, wherein one of the X-axis and the Y-axis extends along a width direction of the excavator, and one of the X-axis and the Y-axis extends along a length direction of the excavator.

5. The method according to claim 1, wherein the determining whether the coordinates (x, y) of the monitoring point are within the boundary lines comprises:

substituting the coordinate values x and y of the coordinates (x, y) of the monitoring point into a function equation y−fn(x) to determine whether a calculation result is positive or negative, wherein it is determined that the monitoring point is within the boundary lines when the calculation result is a predetermined result.

6. The method according to claim 5 further comprising setting the predetermined result, wherein the setting the predetermined result comprises:

placing the monitoring point at a test point (x, y) within the boundary lines, and substituting the coordinate values x and y of the test point into the function equation y−fn(x) to determine whether the calculation result is positive or negative, wherein the predetermined result is negative when the calculation result is a negative number, and the predetermined result is positive when the calculation result is a positive number.

7. The method according to claim 1, wherein obtaining the coordinates of the boundary point in the three-dimensional coordinate system comprises:

determining a distance between the boundary point and the excavator and an azimuth angle with respect to the excavator; and calculating the coordinates of the boundary point in the three-dimensional coordinate system based on the distance and the azimuth angle.

8. The method according to claim 1, wherein obtaining the coordinates of the boundary point in the three-dimensional coordinate system comprises:

moving the monitoring point on at least one of the working arm and the bucket to one boundary point of the working area, reading coordinates of the monitoring point, and taking the coordinates as the coordinates of the boundary point.

9. The method according to claim 1, wherein the monitoring point limited within the boundary lines on at least one of the working arm and the bucket-comprises at least one of:

a first monitoring point positioned at a tip of the bucket at an end away from the second working arm;

a second monitoring point positioned at an end on a bottom of the bucket away from the second working arm;

a third monitoring point positioned at an end on the bottom of the bucket close to the second working arm;

a fourth monitoring point positioned at an end on a top of the bucket close to the second working arm; and a fifth monitoring point positioned at an end of the first working arm close to the second working arm.

10. The method according to claim 1, wherein multiple boundary lines of the working area of the working arm and the bucket of the excavator are obtained at a height in the three-dimensional coordinate system, and the multiple boundary lines are taken as the electrical fence.

* * * * *